United States Patent [19]

Meehan

[11] 4,182,527

[45] Jan. 8, 1980

[54] LATCH HOOKING METHOD

[76] Inventor: Frances R. Meehan, 793 Twin Rivers Dr. North, East Windsor, N.J. 08520

[21] Appl. No.: 900,702

[22] Filed: Apr. 27, 1978

[51] Int. Cl.[2] ..... B65H 69/04

[52] U.S. Cl. ..... 289/1.5; 112/80; 112/266.2; 289/18.1

[58] Field of Search ..... 57/157 TS; 289/1.2, 289/1.5, 18; 112/80, 266

[56] References Cited

U.S. PATENT DOCUMENTS

| | | | |
|---|---|---|---|
| 2,564,245 | 8/1951 | Billion | 57/157 TS |
| 2,676,384 | 4/1954 | Reinhardt et al. | 57/157 TS |
| 2,895,288 | 7/1959 | Yoo | 57/157 TS |
| 3,541,980 | 11/1970 | Barker | 112/80 |
| 3,970,338 | 7/1976 | Crowe | 289/18 X |

FOREIGN PATENT DOCUMENTS

| | | | |
|---|---|---|---|
| 666488 | 10/1929 | France | 112/80 |

*Primary Examiner*—Louis Rimrodt
*Attorney, Agent, or Firm*—Bauer & Amer

[57] ABSTRACT

An improved method and materials for retaining selected lengths of fibrous material to a perforated support grid which may be of miniaturized needlepoint dimensions utilizing latch hooking techniques such that latch hooking may be performed on a needlepoint-type member.

3 Claims, 9 Drawing Figures

LATCH HOOKING METHOD

BACKGROUND OF THE INVENTION

The present invention relates to a method and apparatus for latch hooking on needlepoint-size supports.

In conventional latch hooking, a picture or design is formed on a grid or weave of interlaced threads by securing short lengths of colored twine or rope-like fibrous material such as yarns selectively about the threads that form the grid. The fibrous material commonly employed is of a twisted, multistrand type, each strand being made up of numerous fibrils which may themselves be twisted about one another. Generally, a pattern for the ultimate design is drawn or otherwise imprinted on the grid to serve as a guide for the selective placement of the various colored pieces of yarn or the like.

A latching tool of well-known construction is utilized to attach the lengths of yarn to the grid. Using the tool, a central portion of a length of yarn is looped and passed over a predetermined thread, as indicated by the pattern, and the ends of the piece of yarn are thereafter pulled encirclingly under the thread and through the looped central portion to complete the operation.

The process is sometimes referred to as rug hooking, because while the central portion of the length of yarn is maintained in a wrapped or wound configuration about the thread, its ends extend outwardly from the surface of the grid in the manner of a shag-type carpet or rug. Thus, the ultimate design is formed by a multiplicity of like lengths of yarn of selected colors predeterminately positioned about particular threads on the grid, resembling a patterned long-hair rug.

Typically, the inter-thread sizing of the grid utilized in latch or rug hooking is in the range of 4 to 6 threads per inch. The diameter or cross-sectional thickness of the yarn or the like is selected to substantially conform with the dimensions of the openings or interstices defined between adjacently positioned threads in the grid.

This general correspondence of the yarn diameter and the interstice sizing is necessary to enable effective retention of the yarn on the threads. Inasmuch as each length of yarn is not knotted or tied but merely wound about the thread and thence through its own loop, it is subject to loosening and slippage and consequently to being inadvertently pulled from the grid, leaving an obvious discontinuity or hole in the completed design.

By utilizing relatively thick yarn, each interstice in the grid is substantially filled with the ambient fibrous material of the yarn. The fibrils of adjacently positioned lengths of the yarn frictionally intermesh and interengage with one another to facilitate the retention of the yarn on the threads. In addition, the use of relatively thick yarn provides a particularly dense pile and accordingly contributes to greater continuity in the completed design. As a consequence of the relatively large size of each of the interstices, a grid of substantial overall size is generally required to accommodate a complete picture or design.

It has been found that more attractive patterns and designs can be effected by utilizing latch hooking techniques on needlepoint size surfaces and designs. To do so requires a reduction in the overall size of the grid, a decrease in the space between adjacent threads, as well as a corresponding reduction in the cross-sectional diameter or thickness of the yarn utilized. A smaller latching tool is also required to fit into the interstices. A significant problem, however, arises when the latch hooking procedure is attempted with such reduced-size materials, and more specifically with a spacing between adjacent grid threads that is less than or equal to one-tenth of an inch (ten or more threads per inch).

In particular, it is found that the yarn is no longer adequately retained on the threads. The least application—inadvertent or otherwise—of a pulling force on an outwardly extending end of a thread-engaging piece of yarn causes longitudinal slipping movement of the yarn relative to the thread about which it is wound. The latch hooking method of attachment fails to provide effective retained engagement of the yarn on the threads in the reduced-scale use.

The present invention is based upon a recognition that this lack of positive retention results from the necessity of correspondingly reducing the thickness of the yarn to conform to the reduced size of the grid interstices. Because the yarn used is significantly thinner, it has a substantially smaller circumference and, therefore, many less fibrils for intermeshing and interengagement with the fibrils of adjacently positioned pieces of yarn. Consequently, there is little frictional interaction between adjacent pieces of yarn to facilitate the retention of the same about the threads, and the yarn therefore slips or slides easily thereabout.

It is, therefore, the desideratum of the present invention to enable the application of latch hooking techniques on needlepoint-type and sized supports and to provide for increased non-slip retention of the fibrous material about the threads of the support grid when the fibrous material is engaged about the threads using a latch hooking procedure.

Further objects, features and advantages of the present invention will be more fully appreciated by reference to the following detailed description of a presently preferred, but nonetheless illustrative embodiment in accordance with the present invention when taken in conjunction with the accompanying drawings, wherein.

Figure 9:
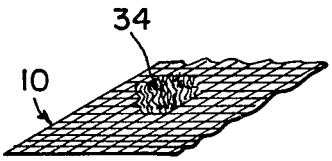
Figure 5:
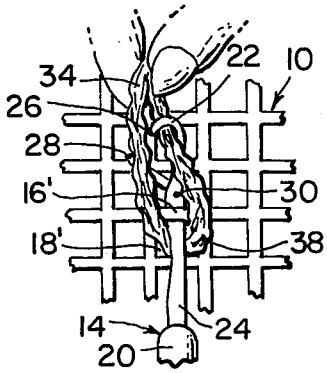

FIGS. 3 through 8 detail the method steps by which a strand of fibrous material is secured to the support grid utilizing the latching tool; and FIG. 9 is a perspective view of a portion of a support grid to which a plurality of strands of fibrous material have been secured in accordance with the teaching of the present invention.

DETAILED DESCRIPTION OF THE PREFERRED EMBODIMENT

Figure 1:
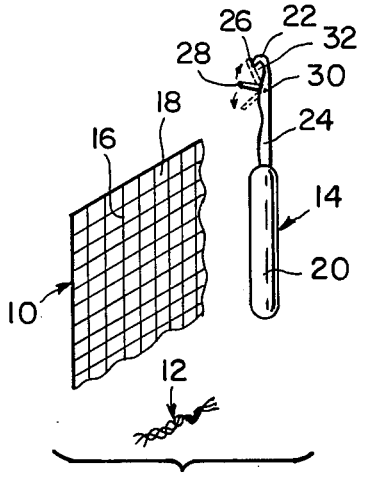
FIG. 1 shows the combination of a portion of a support grid, a length of fibrous material and a latch hooking tool which are utilized in accordance with the teaching of the present invention.

Illustrated in FIG. 1 is a combination of materials utilized in practicing the present invention. In particular, FIG. 1 shows a portion of a support grid 10, a length of fibrous material 12 and a latching or hooking tool generally designated 14, all of which are well known to those skilled in the art of latch hooking. Although only a single length or piece of fibrous material 12 is included in the drawing of FIG. 1, it should be understood that the completion of a picture or design utilizing the materials and techniques to be described hereinafter generally requires a plurality of fibrous pieces 12. The inclusion of but a single length thereof in FIG. 1 is made solely for purposes of illustration and is not intended as a restriction on the scope or teaching of the present invention.

The support grid 10 comprises a plurality of threads individually and collectively designated 16 woven or interlaced with one another or integrally molded in a cross-hatch arrangement to form a perforated sheet of material. By way of example only, the threads 16 may be constructed of canvas or the like and for clarity and ease of description, the grid or sheet 10 will at times be referred to in the specification as being constructed of canvas without intent to so limit the same. In any event, the arrangement of threads 16 serves to define generally rectangular interstices or apertures individually and collectively designated 18 bounded on four sides by substantially perpendicularly arranged pairs of adjacently positioned threads 16. The spacing between all adjacent threads in the cross-hatch arrangement is preferably the same for both the vertical and horizontal directions so that the configuration of each of the interstices 18 is advantageously square as will become clear hereinafter.

In the preferred embodiment of the invention, the spacing between parallel adjacent threads 16 is less than or equal to one-tenth of an inch, corresponding to ten or more threads per running inch. The grid 10 may possess as many as 24 threads per inch, although those skilled in the art will readily recognize that the teaching of the present invention need not be so limited, being equally applicable to an even wider range of sizes of perforate sheet materials.

The latching tool 14 is of well-known construction and generally comprises an elongated body including a gripping and manipulation handle 20 and an arcuate hook member 22 at opposite ends of the body and an elongated shank portion 24 therebetween and connecting the two. The hook 22 is seen more clearly in FIG. 3 to depend from the shank 24 and may be of reduced cross-sectional area relative thereto. The termination or end of the hook 22 may advantageously taper to a point 26 as shown to facilitate its use in a manner that will be described hereafter.

An elongated latching member 28 is pivotally connected at one of its ends to the shank 24 adjacent its juncture with the hook 22 as with a screw or rivet 30. The free end of the latching member 30 is thus disposed for movement through a substantially semi-circular arc as indicated by the arrows in FIG. 1 such that as the member 30 is urged in the direction of the hook 22 and away from the handle 20, its free end makes contact with the hook point 26 and is prevented form further or continued movement in the same direction. As seen in phantom perspective, the latching member 30 in this position forms a closure or bridge from the shank 24 to the hook point 26 spanning the interior arc defined by the hook 22 and completing a strand-capturing passage 32, the use and function of which will be fully delineated as this description proceeds. The free end of the member 30 may likewise be urged back in the opposite direction until prevented from further movement as a result of contact with the shank 24. Such reverse movement of the member 30 opens the strand-capturing passage 32.

Figure 2:
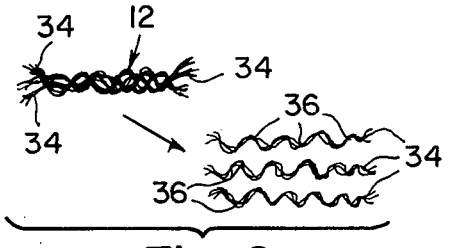
FIG. 2 is a side elevation of a length of fibrous material and the individual strands that together comprise the fibrous material in its initial form.

The fibrous material 12 commonly consists of selectively short lengths of highly flexible cotton or synthetic yarn or the like. As may perhaps best be understood by reference to the FIG. 2 enlargement, the yarn 12 is initially in the form of a loosely twisted aggregate of individual fibers or strands 34 of a preferred length of one and one-half inches. The representation in the drawing of three strands 34 twistingly comprising the yarn 12 is by way of example only and is intended merely as illustrative of the taught use of a yarn having multiple strands twisted about one another. Each of the strands 34 is itself formed of a plurality of randomly intermeshed and interengaged fibrils which combine to define the strand.

The present invention is directed toward a manner of latch hooking on a miniaturized, needlepoint sized grid, as for example the canvas 10. As previously noted, a major problem that arises when standard latch hooking techniques are applied using reduced diameter yarn on a miniaturized grid is an inability to maintain the yarn non-slippingly about the grid threads. As understood, this lack of positive retention results at least in part from a relative absence of effective frictional engagement of the fibrils of adjacently positioned pieces of yarn due to the significantly reduced thickness of the yarn utilized and the corresponding reduction in the number of fibrils present in each piece for intermeshed engagement with fibrils of adjacent pieces. Thus, the yarn is undesirably permitted to easily slip and slide relative to the grid threads.

The present invention provides a solution to this problem by recognizing that the individual strands 34, when untwisted from their initially and normally intertwined arrangement shown at 12, are provided with a plurality of irregular undulations 36 along their lengths. It further recognizes that these irregular undulations 36 may be advantageously utilized to cooperate with the grid threads 16 in such a manner as to facilitate retention of the strands to the threads. The manner of effecting such retention will now be fully described with reference to FIGS. 3 through 8.

Figure 3:
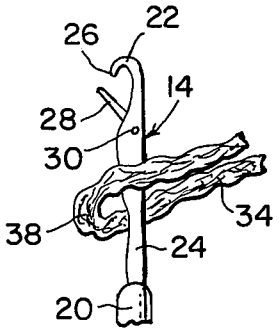
Figure 4:
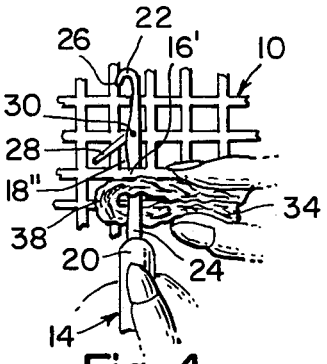

To effect engagement of a strand 34 with one of the threads 16 bounding a selected interstice 18, the latching tool is gripped about its handle 20 and a central portion of the strand 34 is looped, as at 38, about the shank 24 of the latching tool 14 in the manner shown in FIG. 3. Referring now to FIG. 4, the latching tool 14 is operatively positioned relative to the particular thread, designated 16', about which the strand 34 is to be engaged by passing the tool's hook end downward through the interstice 18' on one side of the thread 16', thence under the thread 16' and finally upwardly through the interstice 18" on the opposite or far side of the thread 16'. Forward movement of the hook end of the tool 14 is continued to further insert the same until the latching member 28 also passes under the thread 16' and up through the interstices 18". As the latching member 28 is moved forwardly under the thread 16', it makes contact with the threads bounding the interstice 18' and is urged into its open or downward position by such contact. It should in particular be noted that no portion of the strand 34 looped about the shank 24 is permitted to pass under the thread 16', but that the strand is instead maintained looped about the tool shank 24 proximate its connection with the gripping and manipulating handle 20.

With the latching member 28 still in its open or downwardly disposed position, the free ends of the strand 34 are gripped between fingers of the user's other hand and a central portion of both ends of the strand are placed within the interior arc of the hook 22. This may be seen in FIG. 5. Although the latching member is not yet forming a closure or completion of the strand-capturing passage 32, the strand 34 may be kept or maintained within the arc of the hook 22 and effectively prevented from escaping therefrom by pulling the free ends of the strand upwardly and to the right in FIG. 5 so as to capture the central strand portions within the interior of the hook 22 so long as the free ends are held taut.

Figure 6:
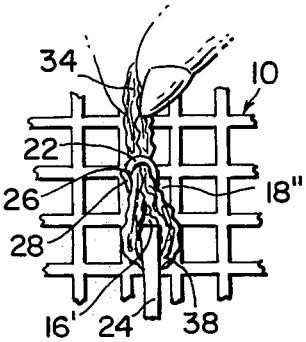
Figure 7:
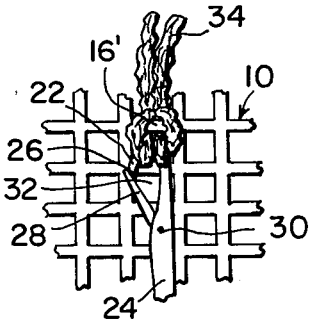

Next, and as seen in FIGS. 6 and 7, the latching tool 14 is pulled downwardly in the drawings so as to remove the tool from its inserted position under the thread 16'. As the shank passes under the thead 16', the latching member 28 is automatically urged into contact with the hook point 26 to close the strand-capturing passage 32 by reason of its contact with the bounds of the interstice 18''. As a consequence, and as may perhaps best be seen in FIG. 7, the free ends of the strand 34 may be released from being gripped by the user's fingers as the hook 22 of the latching tool 14 pulls the same up through the loop 38 in the strand 34, now positioned within the defines of the interstices 18' adjacent the thread 16'.

Figure 8:
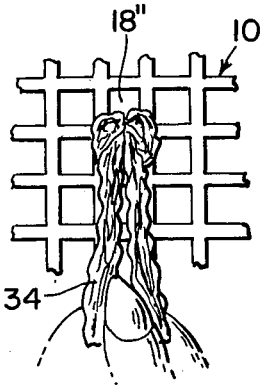

The final engaged position of the strand 34 about the thread 16' is shown in FIG. 8, wherein manipulation of the tool has been completed and the free ends of the strand 34 have been pulled completely through the strand loop 38. The free ends of the strands may be seen to extend outwardly from the surface or plane of the grid 10. This is shown more clearly in FIG. 9 wherein may be seen a plurality of strands similarly attached to the grid 10.

It can, therefore, be understood that the manner of securement of the strand 34 about a selected thread 16' effectively consists of looping a central portion of the strand about the thread and returning the ends of the strand through the strand loop thus formed. It can likewise be appreciated that the irregular undulations in the strand 34 serve to provide increased retention of the strand about the thread by enabling increased cooperation between the strand and the thread, and further by providing enhanced intermeshing and interengagement between the fibrils of those portions of the strand on either side of the centrally located loop. The irregular undulations additionally increase fibril interengagement between strands secured on adjacent threads.

In a manner well known in the art, the selection of the particular threads 16 about which individual strands 34 are to be secured in the described manner is made by designating selected threads on the grid 10 so as to define a pattern for a predetermined design or picture on the grid. This may be effected, for example, by drawing or imprinting upon the perforate sheet 10 a printed outline of the design (not shown). The strands 34 would then be secured to those threads over which the drawn or imprinted pattern passes.

A particular additional advantage which results in the ability to latch hook on a canvas or other grid 10 of reduced size is the possible concomitant use of needlepoint art on the same canvas therewith. Since a grid having a relatively large number of threads per inch is utilized in practicing the present invention, latch hooking, which creates a raised or shag-like design, may be combined with needlepoint, which creates a flat design, on the same perforate sheet 10. This can result in particularly attractive works which were not hitherto practical on this scale.

Although the threads 16 which combine to define the grid 10 are commonly somewhat rigid and inflexible, as for example where the same are formed of canvas, it is within the contemplation of the present invention that the threads 16 be formed of a yieldable or resilient or elastic material such as nylon or other synthetic substance. The use of elastic thread materials such as nylon permits a substantial reduction in spacing between adjacent threads 16 since the interstices 18 can be temporarily deformed for entry of the latching tool 14, and a resilient grid 10 having greater than 24 threads per inch may accordingly be utilized in practicing the invention.

Thus, by way of example, nylon stocking material could form the support grid 10. In a particularly noteworthy manner, the combination of a yieldable or elastic grid 10 and undulation-bearing strands 34 advantageously provides still further enhanced retention of the strands 34 on the threads 16 over the hereinabove disclosed use of the strands 34 with a more conventional canvas or cloth sheet 10.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. An improved method of forming a design by performing latch hooking on a needlepoint-sized sheet comprising:

untwisting a predetermined length of a twisted multistrand fibrous material so as to produce multiple single strands of the fibrous material each having plural irregular undulations along its length, defining a pattern for a predetermined design on a perforated needlepoint-sized sheet comprising a grid-like arrangement adjacent ones of the plural threads by designating selected threads on the perforated sheet, and retaining the single strands of fibrous material to the perforated sheet such that portions of the single strands extend outwardly from the grid-like arrangement of plural threads to form the predetermined design by engaging other portions of the single strands circumferentially about the selected threads such that the irregular undulations of each of the strands cooperate with the selected threads and with the undulations of adjacently retained strands to substantially prevent longitudinal movement of the single strands relative to and to facilitate their retention on the selected threads.

2. In the method according to claim 1, the spacing between adjacently positioned threads of the perforated sheet being less than or equal to 0.1 inches.

3. In the method according to claim 1, the spacing between adjacently positioned threads being such as to provide in the range of ten to twenty-four, and preferably twelve, threads per inch.

* * * * *